United States Patent [19]

Russell

[11] Patent Number: 4,647,515

[45] Date of Patent: Mar. 3, 1987

[54] REINFORCING MATERIAL

[75] Inventor: Derek V. Russell, Ringway, England

[73] Assignee: Alphacrete Construction Linings (UK) Limited, Cheshire, England

[21] Appl. No.: 666,264

[22] Filed: Oct. 29, 1984

[30] Foreign Application Priority Data

Oct. 29, 1983 [GB] United Kingdom ..... 8328935

[51] Int. Cl.[4] ..... B21F 15/08; B32B 3/14; B32B 15/02

[52] U.S. Cl. ..... 428/703; 52/454; 52/600; 140/112; 264/279.1; 264/DIG. 3; 428/594; 428/600; 428/615

[58] Field of Search ..... 428/703, 594, 600, 615; 52/454, 600; 140/112

[56] References Cited

U.S. PATENT DOCUMENTS

| | | | |
|---|---|---|---|
| 1,276,146 | 8/1918 | White | 52/454 |
| 1,524,404 | 1/1925 | Oliver . | |
| 1,926,791 | 9/1933 | Raynor | 52/454 |
| 2,498,586 | 2/1950 | Smith | 52/600 |
| 3,660,215 | 5/1972 | Pawlicki | 428/594 |
| 4,519,177 | 5/1985 | Russell | 264/34 |

FOREIGN PATENT DOCUMENTS

| | | |
|---|---|---|
| 2214934 | 10/1974 | Fed. Rep. of Germany . |
| 2719343 | 11/1976 | Fed. Rep. of Germany . |
| 2527776 | 11/1976 | Fed. Rep. of Germany . |
| 1171215 | 11/1976 | France . |
| 2034128 | 11/1976 | France . |
| 286019 | 7/1968 | Switzerland . |

*Primary Examiner*—James C. Cannon

*Attorney, Agent, or Firm*—Oblon, Fisher, Spivak, McClelland & Maier

[57] ABSTRACT

There is disclosed a reinforcing mat for use in the production of a ferro-cement structure. The mat comprises outer layers of spaced rods or wires having further layers of wire mesh therebetween. The rods or wires of the outer layers are welded together at their crossing points to secure the further layers therebetween.

9 Claims, 2 Drawing Figures

REINFORCING MATERIAL

Figure 1:
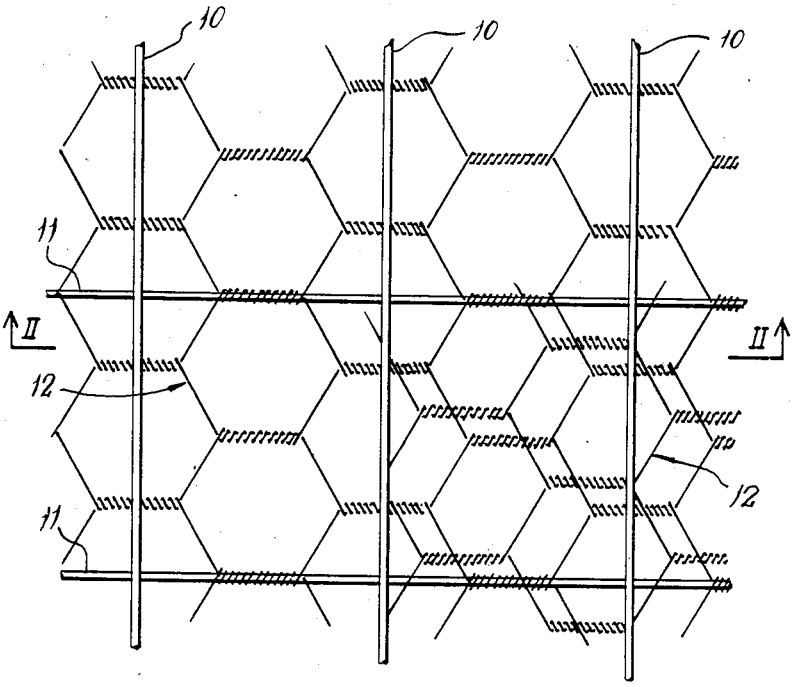

This invention concerns a reinforcing material for use in a ferrocement structure.

A commonly used fabric of steel for use in a ferrocement lay up includes a primary component comprising a plurality of parallel spaced rods in each of two directions at right angles to one another, the rods being welded together at their crossing points. To give more even distribution of steel and strength in other directions, such fabric is overlaid with a secondary component comprising a sheet of wire mesh fabric such as so-called chicken wire for example and the two layers are wired together to form a composite sheet. Often several layers of such composite sheet are overlaid and wired together to form the final reinforcing element which is to be embedded in the mortar.

Producing such composite sheets and reinforcing elements is clearly very labour intensive whether under factory conditions or on site.

It is an object of the present invention to provide a reinforcing material and method of making same which overcomes at least to some extent the problem aforesaid.

According to the present invention there is provided a mat of reinforcing material for use in the production of a ferro-cement structure and having a first layer comprised by spaced steel rods or wires, a second layer comprised by spaced steel rods of wires, the rods or wires of the first layer being at an angle to those of the second layer, and a plurality of further layers of wire mesh fabric disposed between the rods or wires of the first and second layers which are welded together at their crossing points to secure the further layers therebetween.

The invention also includes a method of making the reinforcing mat aforesaid and ferro-cement structures embodying such mats.

The invention will be further apparent from the following description, with reference to the several figures of the accompanying drawings, which show, by way of example only, one form of reinforcing mat embodying the invention constructed in accordance with the method thereof.

Figure 2:
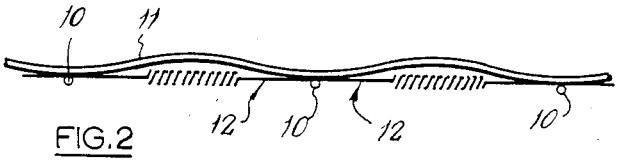

Of the drawing:

FIG. 1 shows a plan view of the mat;

and FIG. 2 shows a cross-section through the mat on the line II—II of FIG. 1.

Referring now to the drawing, it will be seen that the reinforcing mat comprises a layer of spaced parallel longitudinally extending rods 10 and a layer of spaced parallel cross rods 11 at right angles to the rods 10 with a plurality of layers of woven wire mesh fabric 12 such as so-called chicken wire disposed between the rods 10 and rods 11 such that the crossing points between the rods 10 and rods 11 do not overlie the wires of the layers of fabric 12. The rods 10 and 11 are welded together at their crossing points to secure them together and the layers of fabric 12 in position therebetween.

Generally there will be four or even more layers of the fabric 12, though the use of as few as two is possible and such is shown in the drawings, though in the interests of clarity only a fragment of the second layer of fabric is shown. The several layers, whatever their number, are laterally and longitudinally displaced or superimposed in offset relationship whereby the total wire content in the layers 12 is distributed over the total area of the mat substantially as evenly as possible, consistent with the requirement not to have wire between the rods 10 and 11 at their crossing points.

Typical spacings between adjacent rods 10 and adjacent rods 11 will be between 3 inches (7.6 cm) and half an inch (1.3 cm) and the spacing between the rods 10 may be different from that between the rods 11. The rods 10 and 11 may be of square or circular section and of desired gauge, typically from 8 to 22 swg.

Generally the gauge of the rods 10 and 11 will be no more than one gauge up or down on the gauge of the wire from which the mesh fabric 12 is formed and the mesh size of the fabric 12 will generally lie between 1 inch (2.54 cm) and half an inch (1.3 cm) though variations from these recommendations are possible, especially for particular design applications.

Since it is intended that one or more thicknesses of the mat of the invention will be the only reinforcement provided in a ferro-cement structure, the total content of reinforcing material, that is the rods 10, rods 11 and wire in the layers of fabric 12 will occupy at least 8% of the superficial volume of the mat.

The mats can be cut and bent to form ribs, arches, domes or any other shape to correspond with the shape of a ferro-cement structure to be produced.

The mat is produced by continuous stepped feed of the rods 10 from reels thereof along with the required number of layers of woven wire mesh fabric in superimposed relationship over a machine bed. After each step the cross rods 11 are fed onto the bed from the side to cross the rods 10 beneath welding heads which are then lowered to engage the rods 11 and deform them to contact the rods 10 when the heads are actuated to make the welds. The cross rods 11 may be fed and welded one at a time or in groups.

Materials embodying the invention have a tighter than conventional construction giving an increased density of steel, and the corrugated formation of the rods 11 gives added strength.

It will be appreciated that it is not intended to limit the invention to the above example only, many variations, such as might readily occur to one skilled in the art, being possible, without departing from the scope thereof as defined by the appended claims.

Thus, for example, secondary rods or wires may be incorporated along with the wire mesh fabric between the rods 10 and the rods 11.

Again, for example, the rods 10 and the rods 11 need not always be parallel with one another and the two sets need not cross at right angles.

I claim:

1. A mat of reinforcing material for use in the production of a ferro-cement structure, comprising (a) a first layer comprised by first spaced steel rods or wires, (b) a second layer comprised by second spaced steel rods or wires, (c) the said first rods or wires being disposed at an angle to the said second rods or wires so as to define crossing points of the said first and said second rods or wires, (d) a plurality of further layers comprised of wire mesh fabric disposed between the said first and second layers such that the said first rods or wires can contact the said second rods or wires without any wire of said intermediate layers being interposed between said first and second rods or wires at the said crossing points, (e) the rods or wires of one of said first and said second layers being deformed into contact with those of the other of said first and second layers at the crossing points and welded thereto at said crossing points to secure the intermediate layers between said first and said second layers.

2. A mat according to claim 1 wherein the rods or wires in each of the first and second layers are parallel with one another.

3. A mat according to claim 2 wherein the rods or wires in the first layer are at right angles to those in the second layer.

4. A mat according to claim 1 wherein the layers of said plurality of said further layers are superimposed in offset relationship whereby the wire in the further layers is substantially as evenly distributed over the area of the mat as possible.

5. A mat according to claim 1 wherein the reinforcing material of all of said layers occupies at least 8% of the superficial volume of the mat.

6. A mat according to claim 1 wherein each layer of wire mesh fabric is comprised by a woven wire mesh or so-called chicken wire.

7. A mat according to claim 1 wherein further rods or wires are incorporated with said further layers and between said first and second layers.

8. A ferro-cement structure incorporating one or more reinforcing mats according to any of the preceding claims.

9. A method for producing a reinforcing mat for use in the production of a ferrocement structure, comprising:

(a) making a first layer of steel rods or wires by feeding equal lengths of rods or wires from reels on to a bed, (b) feeding a plurality of layers of wire mesh fabric in superimposed relation over the said first layer on the bed, (c) feeding a second layer of rods or wires from reels over the layers of wire mesh fabric, (d) the said first and second layers and the said plurality of layers of wire mesh fabric being such that the rods or wires of the said first and second layers cross at crossing points and no wire of the said layers of wire mesh fabric is between the rods or wires of the first layer and the rods on wires of the second layer at the said crossing points, and (e) lowering welding heads to deform the rods or wires of the said second layer into contact with the rods or wires of the said first layer and actuating said welding heads to weld the rods or wires together at the said crossing points.

* * * * *